United States Patent [19]

Fuerst et al.

[11] Patent Number: 4,947,560

[45] Date of Patent: Aug. 14, 1990

[54] SPLIT VAMP SHOE WITH LATERAL STABILIZER SYSTEM

[75] Inventors: Rory W. Fuerst, Menlo Park, Calif.; James E. Granville, San Antonio, Tex.

[73] Assignee: Kaepa, Inc., San Antonio, Tex.

[21] Appl. No.: 308,254

[22] Filed: Feb. 9, 1989

[51] Int. Cl.[5] ..... A43B 7/18; A43B 7/14

[52] U.S. Cl. ..... 36/88; 36/91; 36/114

[58] Field of Search ..... 36/50, 114, 92, 68, 36/69, 30 R, 88–91

[56] References Cited

U.S. PATENT DOCUMENTS

| | | | |
|---|---|---|---|
| 226,792 | 4/1880 | Robinson . | |
| 537,492 | 4/1895 | Smith | 36/69 |
| 706,551 | 8/1902 | Gordon et al. . | |
| 1,637,897 | 8/1927 | Eddins | 36/69 |
| 1,830,091 | 11/1931 | Cox | 36/69 |
| 3,500,561 | 3/1970 | Epstein | 36/2.5 |
| 4,235,028 | 11/1980 | Riggs | 36/80 |
| 4,255,877 | 3/1981 | Bowerman | 36/129 |
| 4,288,929 | 9/1981 | Norton et al. | 36/69 |
| 4,314,413 | 2/1982 | Dassler | 36/129 |
| 4,354,318 | 10/1982 | Frederick et al. | 36/30 R |
| 4,366,634 | 1/1983 | Giese et al. | 36/114 |
| 4,402,146 | 9/1983 | Parracho et al. | 36/69 |
| 4,559,723 | 12/1985 | Hamy et al. | 36/114 |
| 4,574,498 | 3/1986 | Norton et al. | 36/114 |
| 4,622,763 | 11/1986 | Adams | 36/114 |
| 4,622,764 | 11/1986 | Boulier | 36/68 |
| 4,638,576 | 1/1987 | Parracho et al. | 36/69 |
| 4,769,927 | 9/1988 | Liggett et al. | 36/114 |
| 4,776,111 | 10/1988 | Crowley | 36/114 |
| 4,794,707 | 1/1989 | Franklin et al. | 36/30 R |

FOREIGN PATENT DOCUMENTS

| | | | |
|---|---|---|---|
| 214600 | 4/1956 | Australia | 44.0/44.3 |
| 0146438 | 6/1985 | European Pat. Off. | 36/114 |
| 2162456 | 12/1971 | Fed. Rep. of Germany . | |
| 2420312 | 10/1979 | France . | |
| 15660 | of 1894 | United Kingdom . | |
| 364958 | 4/1931 | United Kingdom . | |
| 821065 | 9/1957 | United Kingdom . | |
| 1093362 | 7/1964 | United Kingdom . | |
| 1108867 | 10/1966 | United Kingdom . | |
| 1187286 | 8/1967 | United Kingdom . | |
| 1345138 | 4/1971 | United Kingdom . | |
| 1316374 | 8/1971 | United Kingdom . | |
| 2173987 | 10/1986 | United Kingdom | 36/114 |

*Primary Examiner*—Steven N. Meyers

*Attorney, Agent, or Firm*—Ronald W. Hind

[57] ABSTRACT

This split vamp athletic shoe (10) includes separated upper and lower vamp sections (18, 22) which are independently adjustable and provide the shoe with a hinge zone providing the shoe with flexibility. The shoe also includes an outsole (14) and a midsole (16), the outsole being unitarily formed to include upwardly extending instep support portions (36) which are attached to the upper vamp and extend substantially to the leading edge of the upper vamp to stiffen the shoe particularly in the instep area and provide stabilizing restraint against lateral motion and enhance the hinge action. The outsole also includes a second set of upwardly extending side support portions (38) which are spaced from said instep side support portions. In a second embodiment the midsole (116) includes unitarily formed side portions (166) recessed to receive the outsole side portions (136) and cooperating with said side portions to provide additional lateral stabilization and further enhancing the hinge action.

11 Claims, 2 Drawing Sheets

FIG. 7.
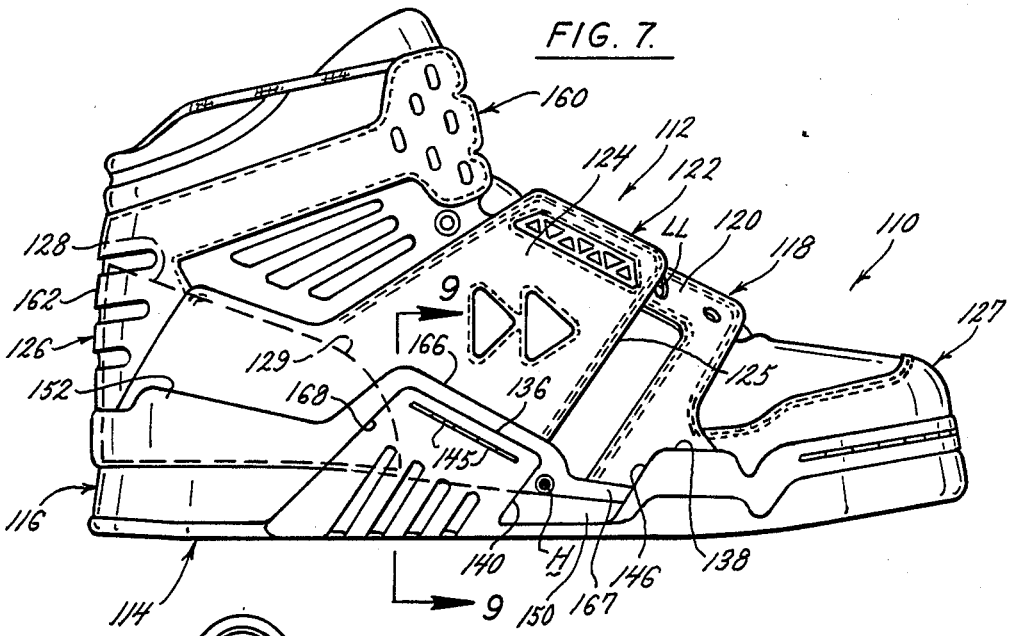
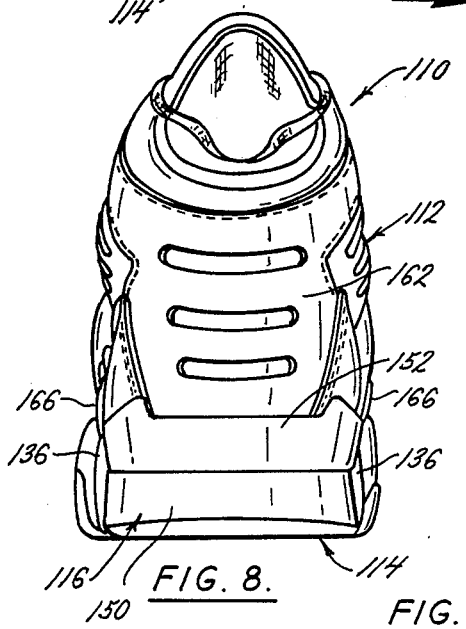
FIG. 8.
FIG. 10.
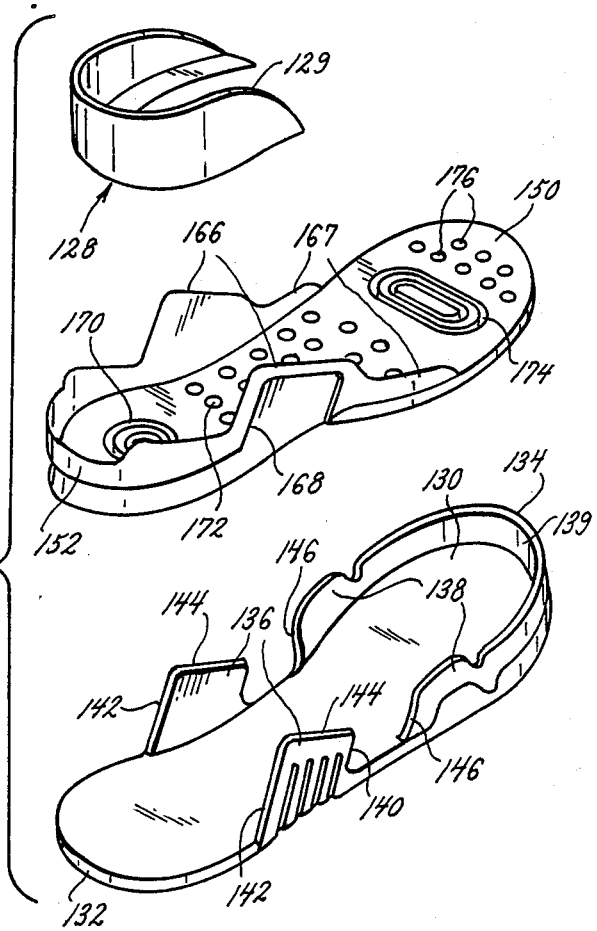
FIG. 9.
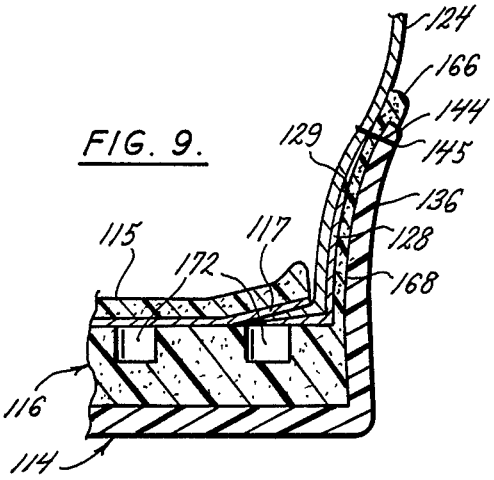

SPLIT VAMP SHOE WITH LATERAL STABILIZER SYSTEM

BACKGROUND OF THE INVENTION:

This invention relates generally to split vamp shoes and particularly to an improved stabilization system which counteracts lateral motion and enhances the pivot action between the vamp sections.

The first commercially successful split vamp shoe is disclosed in commonly owned U.S. Pat. No. 3,546,796. This shoe utilizes two sets of laces to provide independent adjustment of each vamp section and improve the flexible action of the sole. Later improvements disclosed in U.S. Pat. No. 4,200,998, and U.S. Pat. No. 4,538,367 and U.S. Patent Application Ser. No. 07/074,953 filed July 17, 1987, also commonly owned, provide means of utilizing a single continuous lace and yet maintaining the superior adjustment and flexibility of the split vamp concept.

The prior art discloses the use of heel tabs to increase lateral stability of the heel area. For example, U.S. Pat. No. 4,402,146 discloses an athletic shoe having heel tabs overlapping a conventional heel counter. The tabs are intended to extend only substantially to the limits of the heel area defined by the heel counter. In this shoe a wedge-shaped lift portion is disclosed between the outsole and the midsole which has a peripheral horseshoe shaped portion of hard material relative to the softer center portion. The purpose of the horseshoe shape is to cooperate with the heel tabs to resist bulging. While this arrangement provides a partial stiffening rim of relatively hard material, it is a relatively complicated and expensive system.

This invention overcomes the disadvantages noted and enhances the flexible quality of split vamp shoes in a manner not revealed in the known prior art.

SUMMARY OF THE INVENTION

This split vamp shoe combines the advantages of individual vamp adjustment and restraint against lateral motion and, in addition, enhances the pivotal or hinge action of the shoe.

The shoe comprises an upper which includes a lower vamp section, an upper vamp section having an upwardly extending front edge, a heel section and a toe section, said vamp sections having means for adjusting the fit of said sections independently of each other and said sections defining a hinge zone adjacent said front edge facilitating movement of said vamp sections relative to each other. The shoe also includes an outsole including a body portion extending lengthwise of the upper and having a rear end and an instep area and a front end and opposed, upwardly extending side portions said side portions being operatively attached to said upper vamp section extending generally over the instep area and having a rear edge spaced forwardly from the rear end of the sole and a front edge generally adjacent the front edge of the upper vamp section said side portions further defining said hinge zone and providing lateral stiffening in the instep area. The shoe also includes a midsole disposed between said upper and said outsole.

It is an aspect of this invention to provide that said upwardly extending front edges of said upper vamp sections and said corresponding edges of said side portions are substantially parallel and forwardly inclined.

It is another aspect of this invention to provide that said outsole has a second set of opposed, upwardly extending side portions operatively attached to said lower vamp section and having a rear end spaced from the first side portions over the instep area and further defining said hinge zone.

It is yet another aspect of this invention to provide that said second set of side portions are formed from a single U-shaped piece.

Yet another aspect of this invention is to provide that the first set of side portions are substantially taller than said second set.

A further aspect of this invention is to provide that the heel counter is elongate and includes downwardly inclined upper edges extending substantially beyond the front edge of the heel portion to the front edges of associated side portions, and the forwardly inclined front and rear edges of the side portions are connected by associated downwardly inclined upper edges substantially parallel to said heel counter upper edge.

It is another aspect of the invention is to provide that the midsole includes upwardly extending side portions disposed inwardly of said outsole side portions in lapped relation and reinforcing said outsole side portions and yet another aspect to provide that said midsole side portions are recessed to receive said outsole side portions in adhesively attached relation.

It is an aspect of this invention to provide in a split vamp shoe an upper including a lower vamp section, an upper vamp section, a heel section and a toe section, said vamp sections having means for adjusting the fit of said sections independently of each other and said sections defining a hinge zone facilitating movement of said vamp sections relative to each other; an outsole including a body portion extending lengthwise of the upper and having a rear end and a front end; upwardly extending, relatively short, side portions operatively attached to said shoe, and a midsole attached to said outsole.

It is an aspect of this invention to provide a split vamp shoe which is relatively simple and inexpensive to manufacture and is effective in operation.

BRIEF DESCRIPTION OF THE DRAWINGS

FIG. 7 is an elevation view of a modified shoe;

FIG. 8 is a rear elevational view of said shoe;

FIG. 9 is a cross sectional view taken on line 9—9 of FIG. 7 of said shoe; and FIG. 10 is an exploded perspective view of the outsole, midsole and heel counter of said shoe.

DESCRIPTION OF THE PREFERRED EMBODIMENTS

Figure 1:
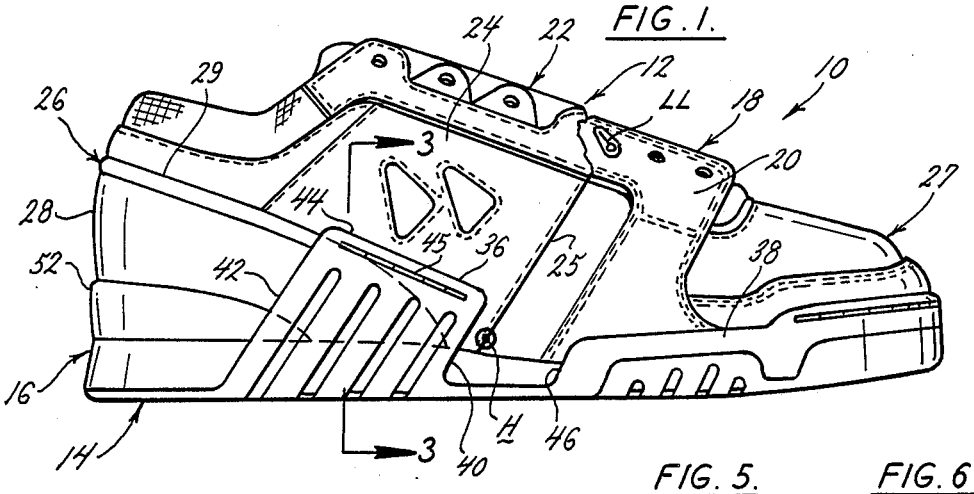
FIG. 1 is an elevational view of one side of the shoe.
Figure 2:
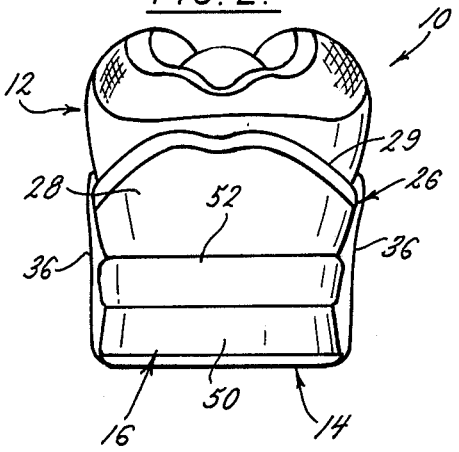
FIG. 2 is a rear elevational view of the shoe.

Referring now by reference numerals to the drawings and first to FIGS. 1–4 it will be understood that the tennis style athletic shoe 10 is of the type generally known as a "split vamp" shoe and includes an upper, generally indicated by numeral 12, an outsole 14, and a midsole 16. It will be further understood that the side of the shoe 10 opposite to that shown in FIG. 1 is generally similar to that shown in FIG. 1. Accordingly, only one side is described and corresponding parts are identified by corresponding numerals.

Figure 5:
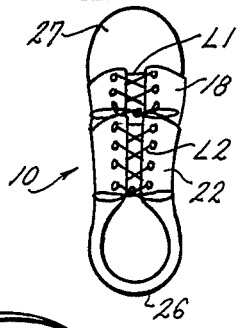
FIG. 5 is a schematic view of a split vamp shoe having separate upper and lower laces.
Figure 6:
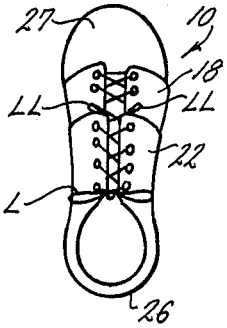
FIG. 6 is a similar view of a shoe having a continuous lace with lace locks in the lower vamp section

The upper 12 includes a first or lower vamp section 18 formed from opposed vamp portions 20 and a second or upper vamp section 22 formed from opposed vamp portions 24 and defined in part by front edges 25. The upper also includes a heel section 26 and a toe section 27, said heel section being formed in part, by a heel counter 28. In the embodiment shown, the upper vamp portions 24 are overlappingly disposed relative to lower vamp portions 20 and are essentially separate from said vamp portions 20 to provide an athletic shoe split vamp construction of the type shown in commonly owned U.S. Pat. Nos. 3,046,796, 4,200,998, and 4,538,367 and U.S. Patent Application Ser. No. 07/074,953 which are incorporated herein by reference. In this type of shoe the upper and lower vamp sections 18 and 22 respectively are separated to provide flexibility between the vamp sections. Such shoes are provided with two individual laces L1 and L2, as shown in FIG. 5, or a single lace L with a locking feature provided by opposed lace locks LL in the upper eyelets of the lower vamp section, as shown in FIG. 6; so that the vamp sections can be independently adjusted for a better fit for the wearer.

In the present improvement the structural arrangement of parts includes a lateral stabilization system which not only provides improved lateral stabilization for the insert open but also improves, the "hinge" nature of the interaction forwardly of the instep area between the vamps which is inherent in the split vamp shoe.

Figure 4:
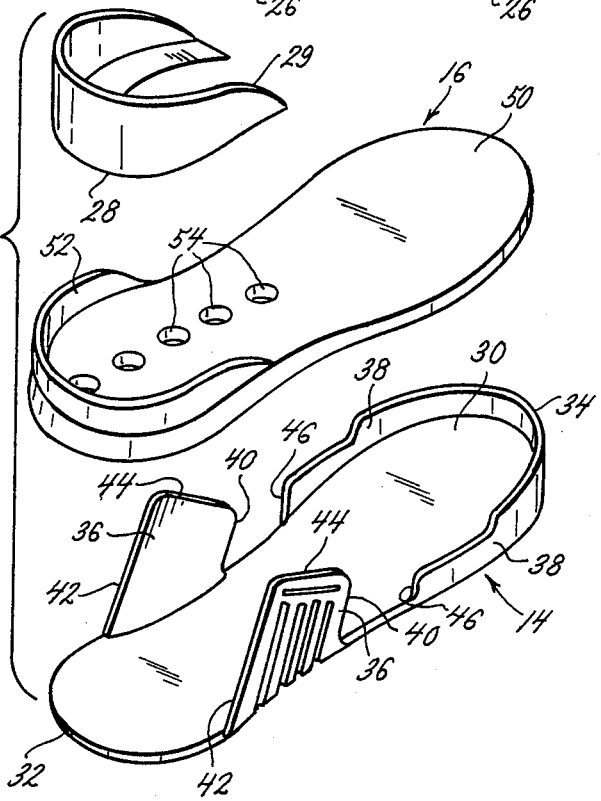
FIG. 4 is an exploded perspective view of the outsole, midsole and heel counter.

As shown in FIGS. 1 and 4, the outsole 14, which is formed from plastic or the like having a durometer hardness of 50°-68° , shore A includes a generally flat body portion 30 having a rear end 32 and a front end 34 and upwardly extending opposed side portions 36 and 38 unitarily formed with said flat portion 30. Side portions 36 provide a first set of upwardly extending side portions and side portions 38 provide a second set of upwardly extending opposed side portions.

Side portions 36 are spaced from the outsole end 32 and include front and rear upwardly inclined parallel edges 40 and 42, respectively, connected by a downwardly inclined upper edge 44. Forwardly disposed side portions 38 are unitarily formed from a U-shaped piece and include rearward edges 46 spaced from the forward edges 40 of rearwardly disposed side portions 36.

As shown in FIG. 1 the front edges 40 of the rear side portions 36 are substantially parallel to and adjacent to the front edges 25 of the upper vamp portions 24. The heel counter 28, which includes downwardly inclined upper edges 29, extends a substantial distance beyond the heel area and terminates a short distance before the vamp edge 25 and the front edge 40 of the side portion 36. The downwardly inclined upper edges 44 of the side portions 36 are substantially parallel to the upper edge 29 of the heel counter 28 and said side portions 36 overlie and are attached to said heel counters 28 as by adhesive and are attached to said upper vamp portions 22 as by stitching 45. The result of this structural arrangement of parts, whereby the heel counter 28 and the side portions 36 overlie the upper vamp, portions 22, provides a reinforced portion of the shoe over the instep area adjacent the hinge zone indicated by H and facilitates flexing of the shoe 10 at this location. The front side portions 38 are attached to said toe section 27 as by adhesive.

The midsole 16, which is of foam such as EVA having a durometer hardness of 50°-60° (C.) generally conforms to the configuration of the outsole portion 30 to include a body portion 50 but, in addition, includes a U-shaped portion 52 unitarily formed with said body portion 50 attached which is adhesively attached to said heel counter 28 and reinforces the peripheral heel area. From the rearward end of the counter 28 to the forward end and beyond, the midsole 16 is provided with a plurality of recesses 54, which act to increase the cushioning effect of the midsole in this area by substituting air pockets for the midsole foam material. The side portions 36, act to reinforce the upper 12 and provide lateral support forwardly into the instep area the instep area and rearwardly to a point partially extending into the heel area.

In the preferred embodiment, as shown in FIG. 4 a separate insole 15 is provided and the midsole 16 includes a board 17 as is conventional.

From the above it will be understood that while the rear side portions 36 cooperate with the heel counter 28 and the upwardly extending midsole portion 52 to provide lateral stabilization said side portions also cooperate with the forward side portions 38 to define the hinge pivotal zone which exists between said forward and rearward side portions.

A second embodiment of the split vamp shoe is shown in FIGS. 7-10 and is a basketball style athletic shoe 110 which is similar to the shoe 10 in that it includes an upper 112, an outsole 114 and a midsole 116 The upper 112 includes a lower vamp section 118 formed from opposed vamp portions 120 and an upper vamp section 122 formed from opposed vamp portions 124 defined by front edges 125. The upper also includes an additional high top vamp area indicated by numeral 160 which defines the shoe as a basketball shoe. The upper includes a heel section 126 and a toe section 127 said heel section being formed in part by a heel counter 128. As with shoe 10, the upper vamp portions 124 are overlappingly disposed relative to said lower vamp portions 122 to provide the split vamp effect.

As shown in FIGS. 7 and 10 the outsole 114, which is formed from plastic or the like, having a durometer hardness of 50°-68° (A), includes a generally flat body portion 130 having a rear end 132 and a front end 134 and first and second sets of upwardly extending side portions 136 and 138 respectively, unitarily formed with said body portion 130. The side portions 138 are interconnected by a U-shaped portion 139 also unitarily formed with said portion 130. Side portions 136 provide a first set of upwardly extending side portions. Side portions 136 are spaced from the outsole end 132 and include front and rear upwardly inclined parallel edges 140 and 142 connected by downwardly inclined upper edge 144. Side portions 138 include rearward edges 146 spaced from forward edges 140 of side portion 136. As shown in FIG. 7 the front edges 140 of side portions 136 are substantially parallel to and adjacent to the front edges 125 of vamp portions 124. The heel counter 128 is covered by an outer heel area 162 and includes a downwardly inclined upper and forwardly curved upper edge 129 extending beyond the heel area.

Figure 3:
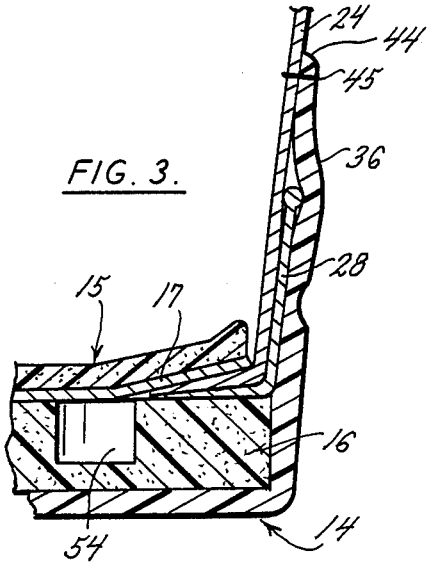
FIG. 3 is a cross sectional view taken on line 3—3 of FIG. 1.

The midsole 116 which is of foam such as polyurethane having a durometer hardness of 50°-60° (C.), generally conforms to the configuration of the outsole portion 130 to include a body portion 150, a unitarily formed U-shaped portion 152 which is adhesively attached to said heel counter 128 and reinforces the peripheral heel area. Distinguishing from the shoe 10 the midsole 116 also includes upwardly extending side portions 166 unitarily formed with said body portion 150 and said U-shaped portion 152. Side portions 166 include a forward portion 167 but are otherwise similar in shape to said outsole side portions 136. The midsole side portions 166 are recessed at 168 to receive said side portions 136 and thereby providing further side reinforcing for said portions 136. The outsole side portions 136 are adhesively attached to said midsole side portions 166 which are adhesively attached to said upper vamp portions 122. As shown in FIGS. 1 and 3 the parts are additionally secured to said upper vamp by a line of stitching 145.

The midsole 116 is additionally cushioned by providing a plurality of annular rings 170 in the heel area, circular recesses 172 in the instep area and a combination of oval-shaped grooves 174 and circular recesses 176 in the area of the ball of the foot.

It will be understood that the rear side portions 136 and 166 cooperate with the heel counter 128 and the midsole portion 152 to provide lateral stabilization in the instep area, said combined side portions 136 and 166 also cooperate with the forward side portions 138 to define a hinge zone between said forward and rearward side portion forwardly of the instep area. The lace arrangement of shoe 110 vamp sections is similar to that for shoe 10.

Although the improved split vamp shoe has been described by making particularized reference to preferred structural arrangements of parts, the details of description are not to be understood as restrictive, numerous variants being possible within the principles disclosed and within the fair scope of the claims hereunto appended.

For example, although the parts are referred to in some instances as adhesively attached they can be where appropriate, stitched, fused, molded or otherwise attached. Also, the outsole front and rear side supports can be attached to the outsole body portion by adhesive or other means rather than by being unitarily formed. Further, the side supports may be separate from the outsole and attached to the upper, or attached to the outsole and separate from the upper. Also, the forward set of side supports can be formed independently of the U-shaped portion around the toe.

It will be understood that in the description the terms lower and upper vamp sections have been used for convenience and include portions of the shoe which may be conventionally referred to by other terms. For example, the midportion of the shoe forward of the counter is conventionally known as the quarter.

We claim as our invention:

1. In a split vamp shoe:

(a) an upper including a lower vamp section, an upper vamp section having an upwardly extending front edge, a heel section and a toe section and an instep section in the area corresponding generally to the arched middle portion of the foot, said vamp sections having means for adjusting the fit of said sections independently of each other and said sections defining a hinge zone adjacent said front edge facilitating movement of said vamp sections relative to each other;

(b) an outsole including a body portion extending lengthwise of the upper and having a rear end and a front end and an instep area in the area corresponding generally to the arched middle portion of the foot and a first set of opposed, upwardly extending side portions extending generally over the instep area and extending into and operatively attached to the instep section of the upper and having a rear edge spaced forwardly from the rear end of the outsole and a front edge generally adjacent the front edge of the upper vamp section and further defining said hinge zone and providing lateral stiffening and support for the instep section of the upper above the instep area of the outsole; and (c) a midsole disposed between said upper and said outsole and attached to said outsole.

2. A split vamp shoe as defined in claim 13, in which:

(d) said upwardly extending front edges of said upper vamp sections and adjacent front edges of said side portions are substantially parallel and forwardly inclined.

3. A split vamp shoe as defined in claim 13, in which:

(d) said outsole has a second set of opposed, upwardly extending side portions operatively attached to said lower vamp section and having a rear end spaced from the first set of side portions over the instep area and further defining said hinged zone which further facilitates movement of said vamp sections relative to each other.

4. A split vamp shoe as defined in claim 3, in which:

(e) said second set of side portions are formed from a single continuous U-shaped piece.

5. A split vamp shoe as defined in claim 3, in which:

(e) the first set of side portions are substantially taller than said second set of side portions.

6. A split vamp shoe as defined in claim 1, in which:

(d) the heel section includes an elongated heel counter having a front portion extending forwardly over the instep area substantially to the front edge of the upwardly extending side portions.

7. A split vamp shoe as defined in claim 1, in which:

(d) the front and rear edges of the side portions are forwardly inclined and generally parallel.

8. A split vamp shoe as defined in claim 1, in which:

(d) the heel section includes a heel counter and said heel counter is elongate and includes downwardly inclined upper edges extending substantially beyond the front edge of the heel portion to the front edges of associated side portions, and (e) the front and rear edges of the instep area side portions are forwardly inclined and generally parallel and are connected by associated downwardly inclined upper edges substantially parallel to said heel counter upper edge.

9. A split vamp shoe as defined in claim 1, in which:

(d) the midsole includes upwardly extending side portions disposed inwardly of said outsole side portions in lapped relation and reinforcing said outsole side portions which further facilitates movement of said vamp sections relative to each other.

10. A split vamp shoe as defined in claim 9, in which:

(e) said midsole side portions are recessed to receive said outsole side portions in adhesively attached lapped relation.

11. In a split vamp shoe:

(a) an upper including a lower vamp section, an upper vamp section having an upwardly extending front edge, a heel section and a toe section and an instep section in the area corresponding generally to the arched middle portion of the foot, said vamp sections having means for adjusting the fit of said sections independently of each other and said sections defining a hinge zone adjacent said front edge facilitating movement of said vamp sections relative to each other;

(b) an outsole extending lengthwise of the upper and having a rear end and a front end and an instep area in the area corresponding generally to the arched middle portion of the foot, (c) a first set of opposed, upwardly extending side portions attached to said outsole, and extending into the instep section of the upper above the instep area of the outsole, (d) a midsole extending lengthwise of the upper and having a rear end and a front end and an instep area in the area corresponding generally to the arched middle portion of the foot, and (e) a second set of opposed, upwardly extending side portions attached to said midsole and extending into the instep section of the upper above the instep area of the midsole, said first set of side portions being disposed outwardly of said second set of side portions and said first set and said second set of side portions being operatively attached to the instep section of the upper and cooperating to provide lateral stabilization and support for the shoe in the instep section of the upper above the instep area of the outsole and midsole.

* * * * *